US010315873B2

(12) United States Patent
Perini

(10) Patent No.: US 10,315,873 B2
(45) Date of Patent: Jun. 11, 2019

(54) PIN FOR SUPPORTING PAPER REELS IN PAPER CONVERTING PLANTS

(71) Applicant: FUTURA S.P.A., Capannori (LU), Fraz., Guamo (IT)

(72) Inventor: Fabio Perini, Viareggio (IT)

(73) Assignee: FUTURA S.P.A., Capannori (LU), Frax, Guamo (IT)

( * ) Notice: Subject to any disclaimer, the term of this patent is extended or adjusted under 35 U.S.C. 154(b) by 150 days.

(21) Appl. No.: 15/512,732

(22) PCT Filed: Sep. 17, 2015

(86) PCT No.: PCT/IT2015/000232
§ 371 (c)(1),
(2) Date: Mar. 20, 2017

(87) PCT Pub. No.: WO2016/046855
PCT Pub. Date: Mar. 31, 2016

(65) Prior Publication Data

US 2017/0240369 A1 Aug. 24, 2017

(30) Foreign Application Priority Data

Sep. 23, 2014 (IT) ..... FI2014A0221

(51) Int. Cl.
*B65H 19/12* (2006.01)

(52) U.S. Cl.
CPC . *B65H 19/126* (2013.01); *B65H 2301/41346* (2013.01); *B65H 2301/41732* (2013.01);
(Continued)

(58) Field of Classification Search
CPC ..... B65H 19/126; B65H 2301/41346; B65H 2301/41732; B65H 2801/84;
(Continued)

(56) References Cited

U.S. PATENT DOCUMENTS 4,149,682 A * 4/1979 Gustafson ..... B66C 1/54 242/571.3
4,154,412 A * 5/1979 Briar ..... B65H 75/245 242/571.8
(Continued)

FOREIGN PATENT DOCUMENTS

EP 1 136 406 A2 9/2001
EP 1 386 866 A2 2/2004
(Continued)

*Primary Examiner* — Michael R Mansen
*Assistant Examiner* — Mark K Buse
(74) *Attorney, Agent, or Firm* — McGlew and Tuttle, P.C.

(57) ABSTRACT

Support pin for supporting reels of paper material, comprising an outer side (PX) and an inner side (PN), with the inner side (PN) that is adapted to be inserted into a reel (1) of paper material and with the outer side (PX) that remains on the outside of the same reel (1) when the inner side (PN) is inside the reel (1), said outer side (PX) being provided with a hooking portion (3) adapted to be engaged by means (CP) adapted to vertically move the pin (P). The outer side (PX) of the pin (P) is constituted by a shank (2) whose longitudinal axis coincides with the longitudinal axis (x-x) of the pin (P) and said hooking portion comprises an eyelet formed on the shank (2) and delimited by two parallel arms (30) that emerge radially from the shank (2) and are joined by a body (31) parallel to said longitudinal axis (x-x).

15 Claims, 14 Drawing Sheets

(52) U.S. Cl.
CPC .. *B65H 2405/422* (2013.01); *B65H 2405/423* (2013.01); *B65H 2511/15* (2013.01); *B65H 2515/31* (2013.01); *B65H 2553/212* (2013.01); *B65H 2801/84* (2013.01)

(58) Field of Classification Search
CPC ..... B65H 2405/423; B65H 2511/15; B65H 75/02; B65H 75/18
USPC ..... 242/571.8, 572, 599.3
See application file for complete search history.

(56) References Cited

U.S. PATENT DOCUMENTS

| | | | | |
|---|---|---|---|---|
| 4,195,759 | A | 4/1980 | Rogers | |
| 4,284,251 | A * | 8/1981 | Salvador Castillo | B65H 75/242 242/573.4 |
| 5,820,069 | A * | 10/1998 | Segura Salvador | B23B 31/404 242/571.3 |
| 2017/0240370 | A1* | 8/2017 | Perini | B65H 26/00 |
| 2017/0240378 | A1* | 8/2017 | Perini | B65H 75/242 |

FOREIGN PATENT DOCUMENTS

| | | | |
|---|---|---|---|
| JP | S59 169622 | A | 9/1984 |
| JP | H04 85437 | U | 7/1992 |

* cited by examiner

PIN FOR SUPPORTING PAPER REELS IN PAPER CONVERTING PLANTS

The present invention relates to a pin for supporting paper reels in paper converting plants.

It is known that the production of paper logs implies the feeding of a continuous paper web along a predetermined path. The paper web is transversely perforated at a predetermined point of said path so that it is divided into sheets of predetermined length separable by tearing. Furthermore, use is made of tubular elements (commonly said cores) on whose surface is applied a predetermined amount of glue to allow the glueing of the first sheet of the log to be formed. Moreover, use is made of winding rollers, positioned and acting in logs formation station, that cause the rotation of the core on which the paper is wound. The formation of a log ends when a given amount of paper is wound on the core. Then, another log is formed. When the formation of a log is completed, the last sheet of the log must be glued on the underlying sheet to avoid the spontaneous unwinding of the log. Each log is then subdivided into a plurality of shorter rolls by means of cutting-off machines.

In order to permit the proper running of the process, a paper converting plant always comprises an unwinder where are positioned the parent reels from which the paper web is fed. The unwinders comprise, in particular, base for supporting each parent reel and the latter can rotate about its longitudinal axis since it is attached to two supporting pins, each of which is removably inserted in a corresponding side of the parent reel. When the paper is unwound, the parent reel is on the base of the unwinder and the pins are inside the parent reel, while, generally, when the parent reel is almost exhausted and must be substituted, the pins are extracted to free it.

The present invention relates to the structure of the pins destined to support the parent reels in the unwinders and aims at facilitating the loading of the parent reels on the unwinders and, respectively, their handling and removal.

This result is achieved, according to the present invention, by providing a device having the features indicated in claim 1. Other features of the present invention are the subject of the dependent claims.

A pin in accordance with the present invention is shaped in such a way that it is kept coupled to a respective arm of the bridge crane used to move the parent reel while it is still supported by the respective support of the unwinder. In addition, a pin in accordance with the present invention is simple to make and is very cheap in relation to the advantages offered.

These and other advantages and features of this invention will be best understood by anyone skilled in the art thanks to the following description and to the attached drawings, provided by way of example but not to be considered in a limiting sense, in which.

Figure 6:
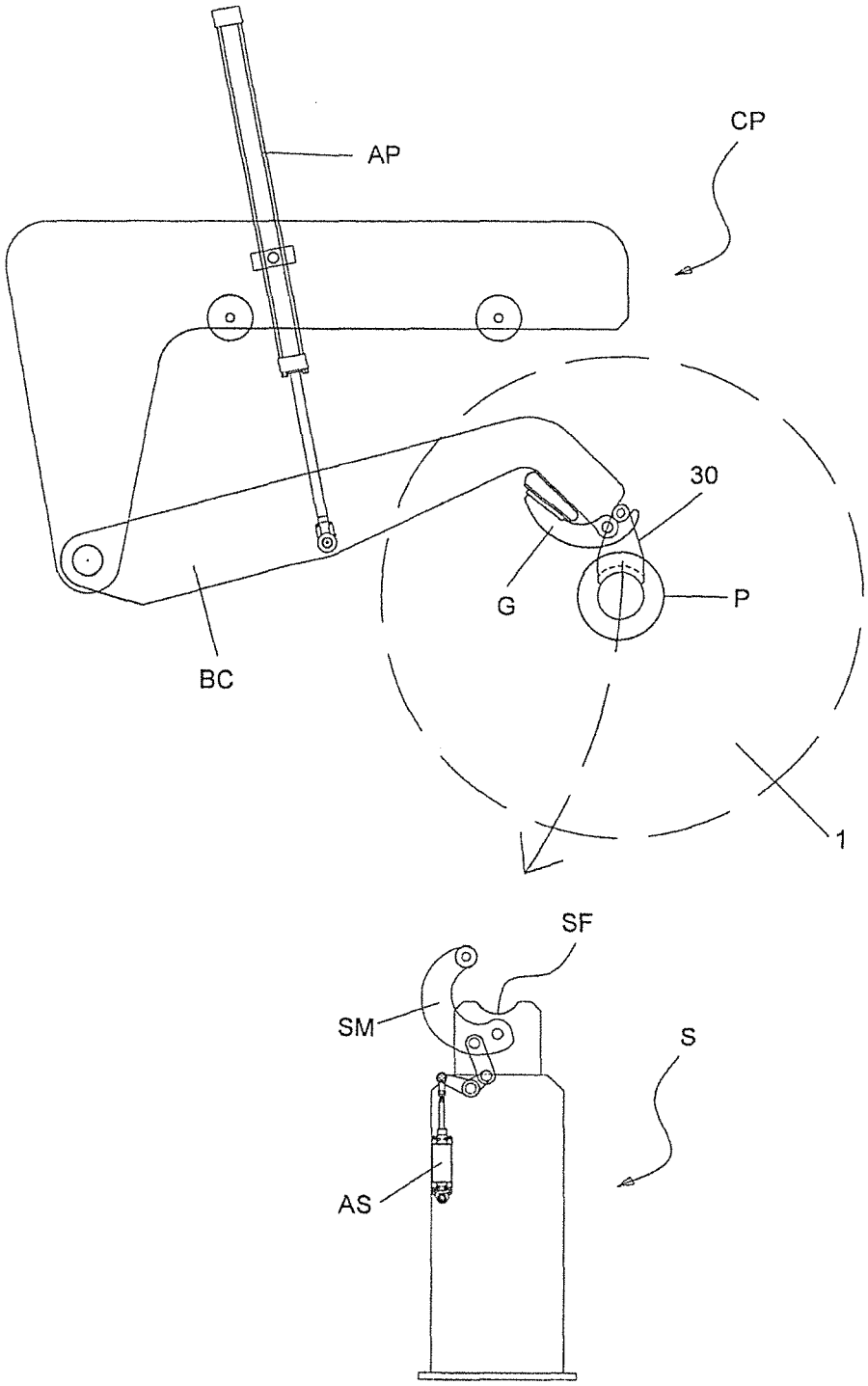
Figure 12:
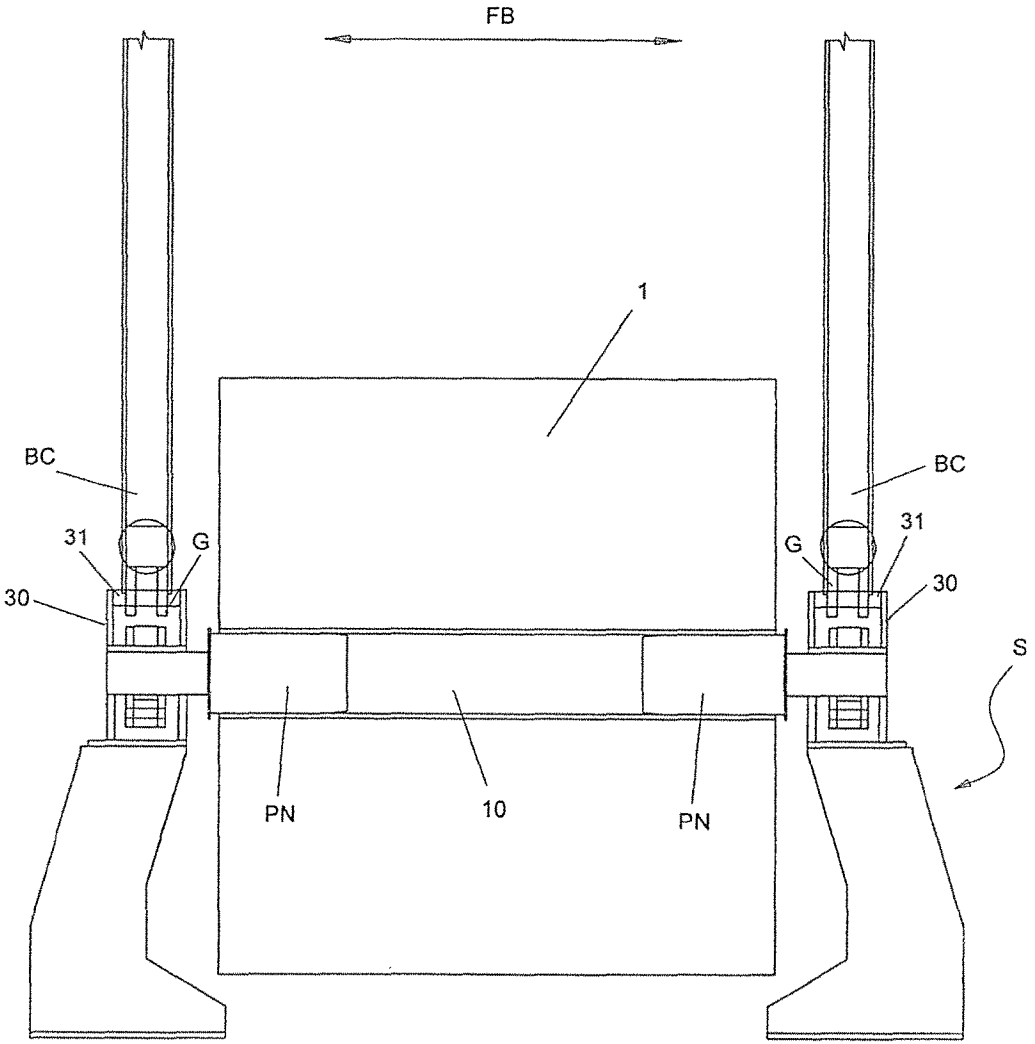
Figure 14:
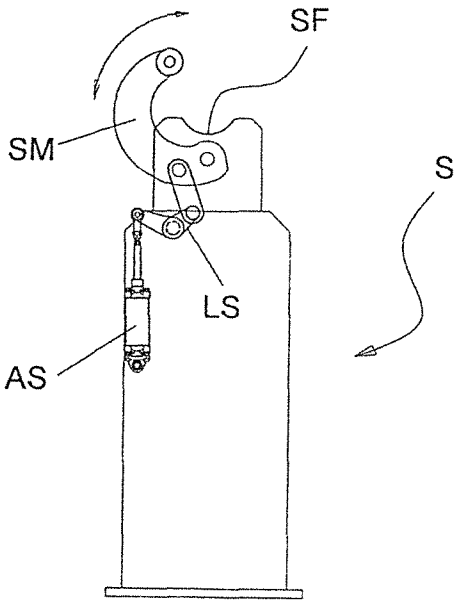
Figure 13:
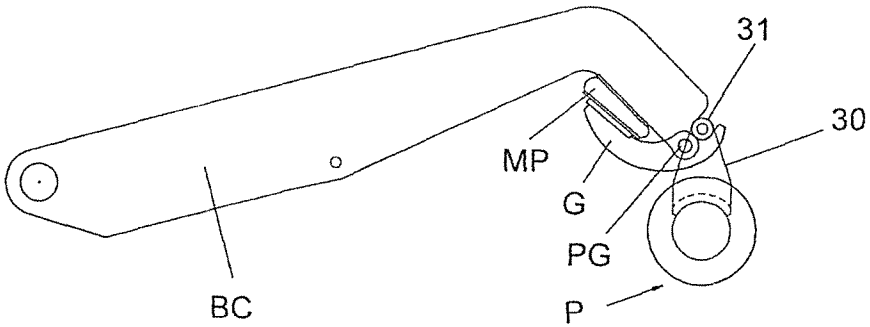
Figure 15:
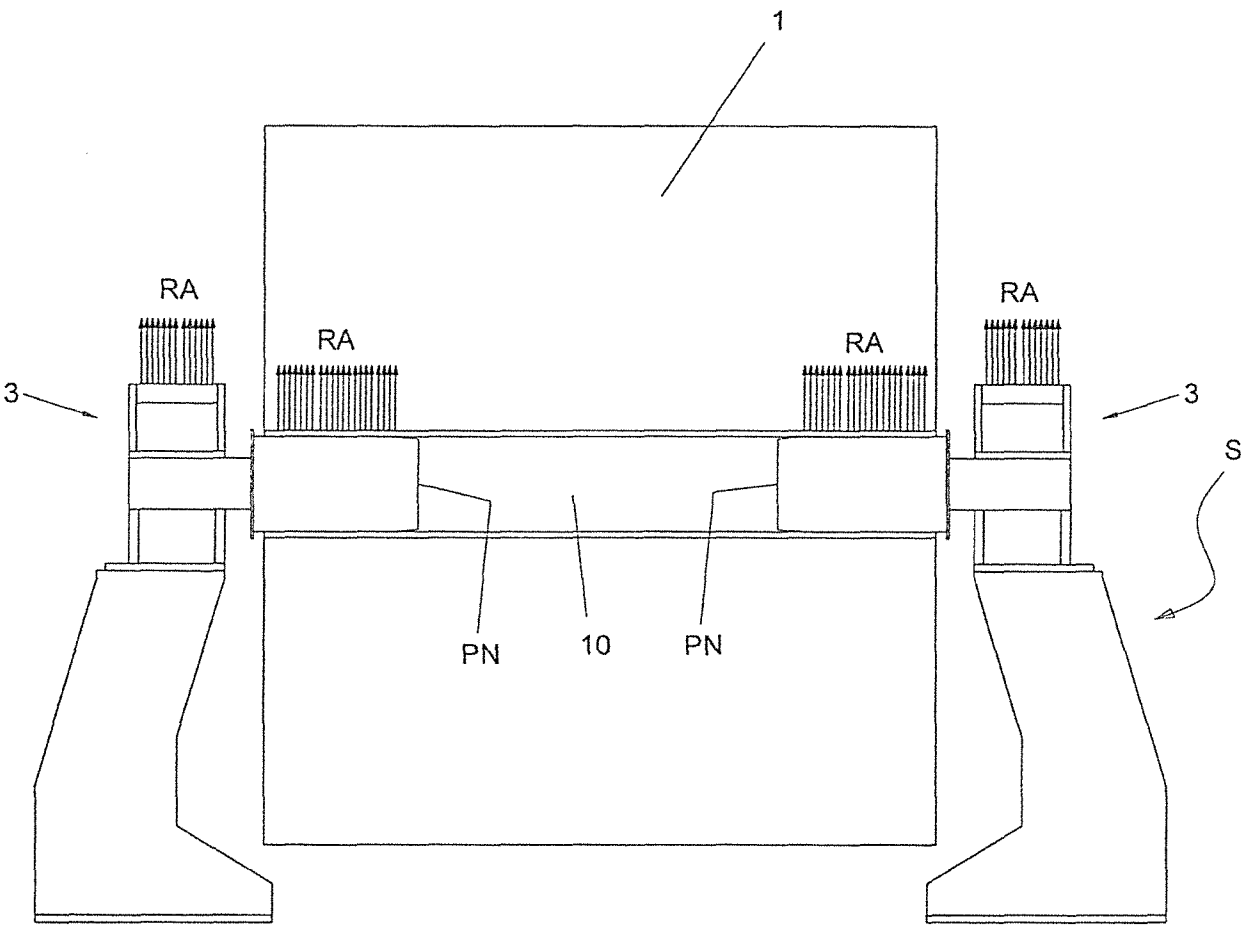

FIGS. 6-11 schematically show a sequence of steps concerning the handling of the pin by means of a bridge crane, where the parent reel is shown in FIG. 6 only to illustrate the movements more clearly;

FIG. 12 is a schematic side view of the parent reel with the pins inserted in the opposite ends of the respective core;

FIGS. 13 and 14 are two details of FIG. 12;

FIG. 15 schematically shows the forces acting on the parent reel (A) when the latter is raised.

A pin (P) according to the present invention is of the type destined to be inserted into a corresponding end of the core (10) of a parent reel (1) that can be used in an unwinder of a paper converting plant.

Figure 1:
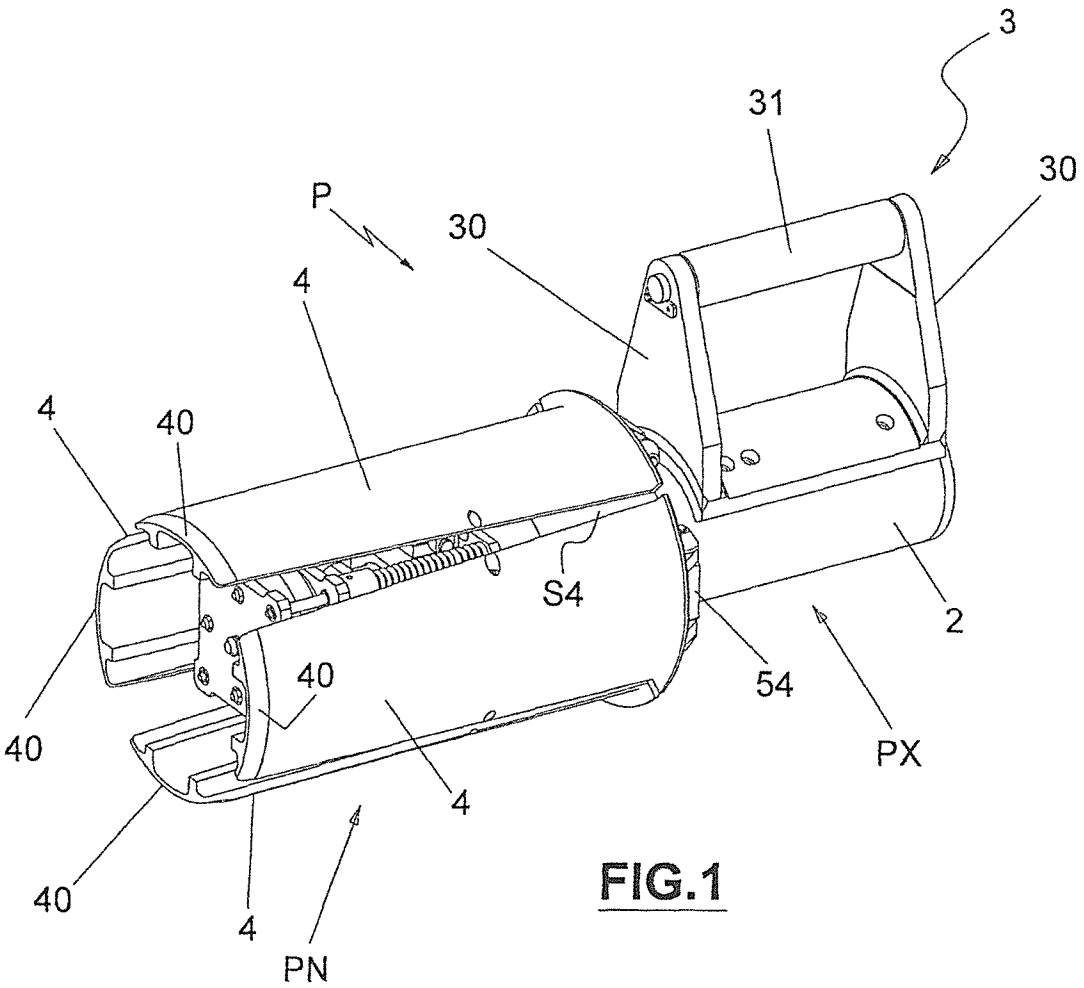
FIG. 1 is a schematic perspective view of a pin according to the present invention.
Figure 2:
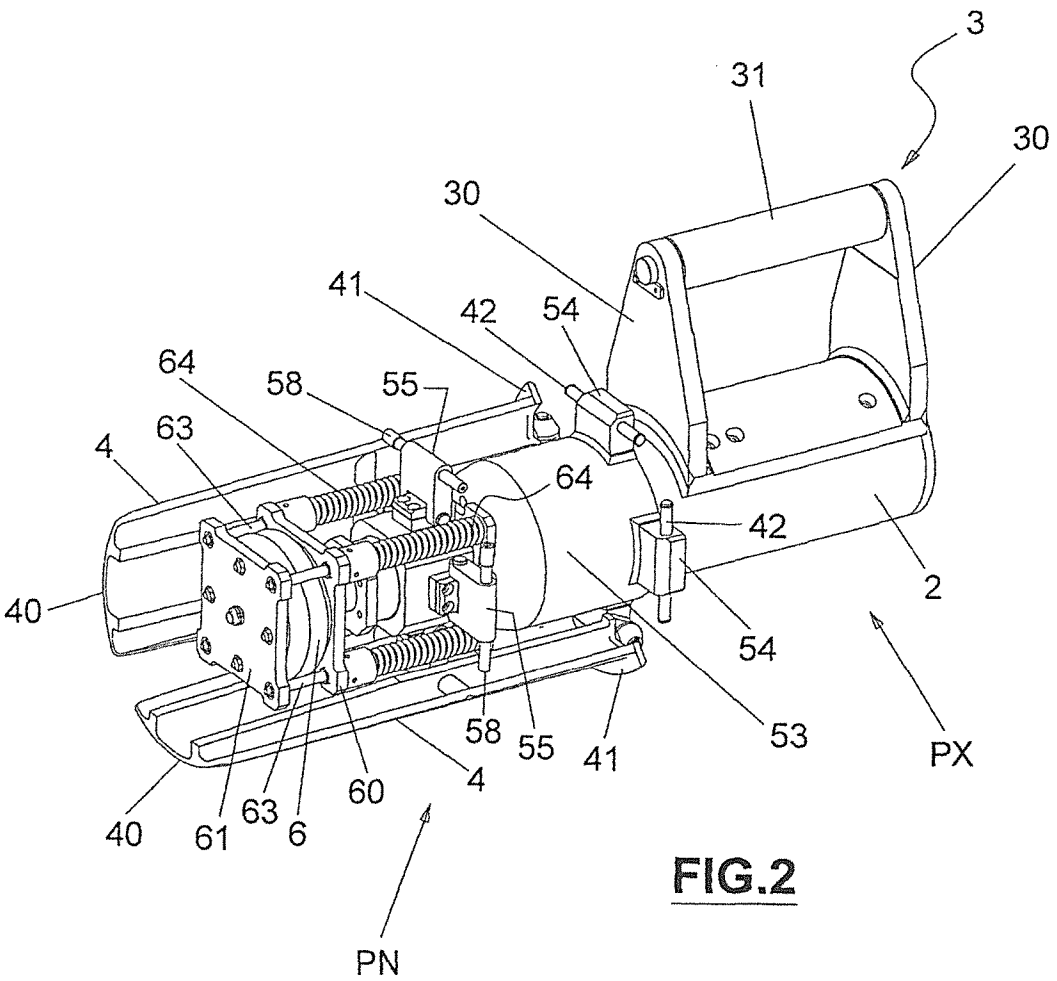
FIG. 2 shows the pin of FIG. 1 with two sectors removed to better show the inside.
Figure 4B:
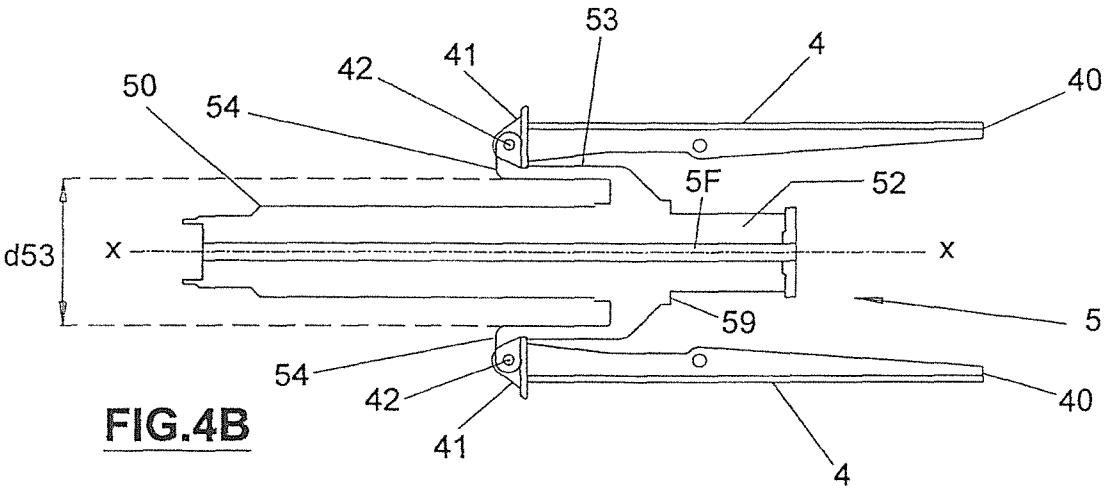
FIG. 4B shows a group of components isolated from the unit shown in FIG. 4A.
Figure 3:
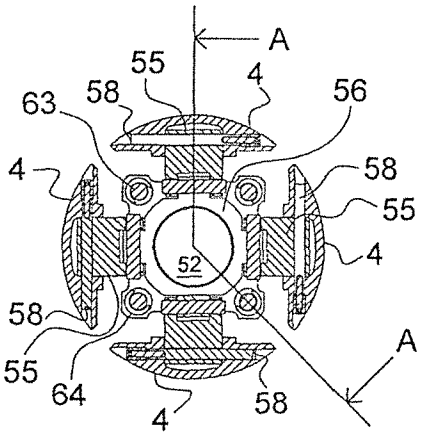
FIG. 3 is a cross section view of the pin shown in FIG. 1.
Figure 4A:
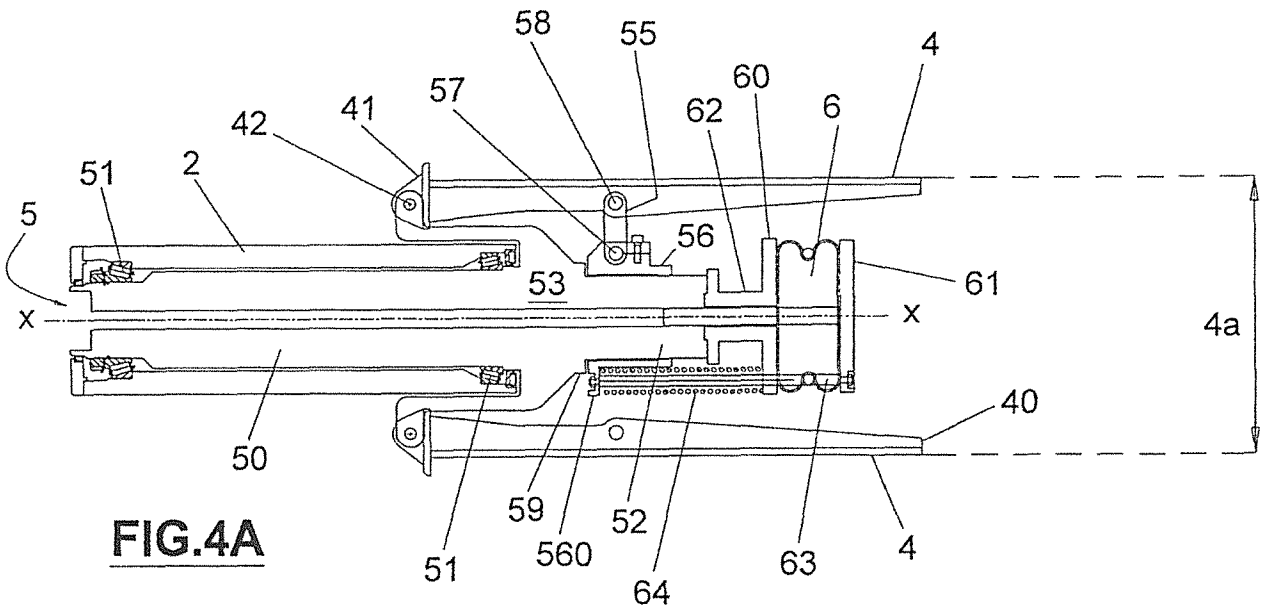
FIG. 4A is a section along line A-A of FIG. 3.

The pin (P) has an outer side (PX) and an inner side (PN), the inner side (PN) being destined to be inserted into the core (10) of the reel (1) and the outer side being external to the same reel (1) when the inner side (PN) is inside the core (10). In FIG. 1 and FIG. 2 the outer side (PX) is on the right while the inner side (PB) is on the left. The pin (P) is substantially symmetrical with respect to a central longitudinal axis (x-x).

Figure 5:
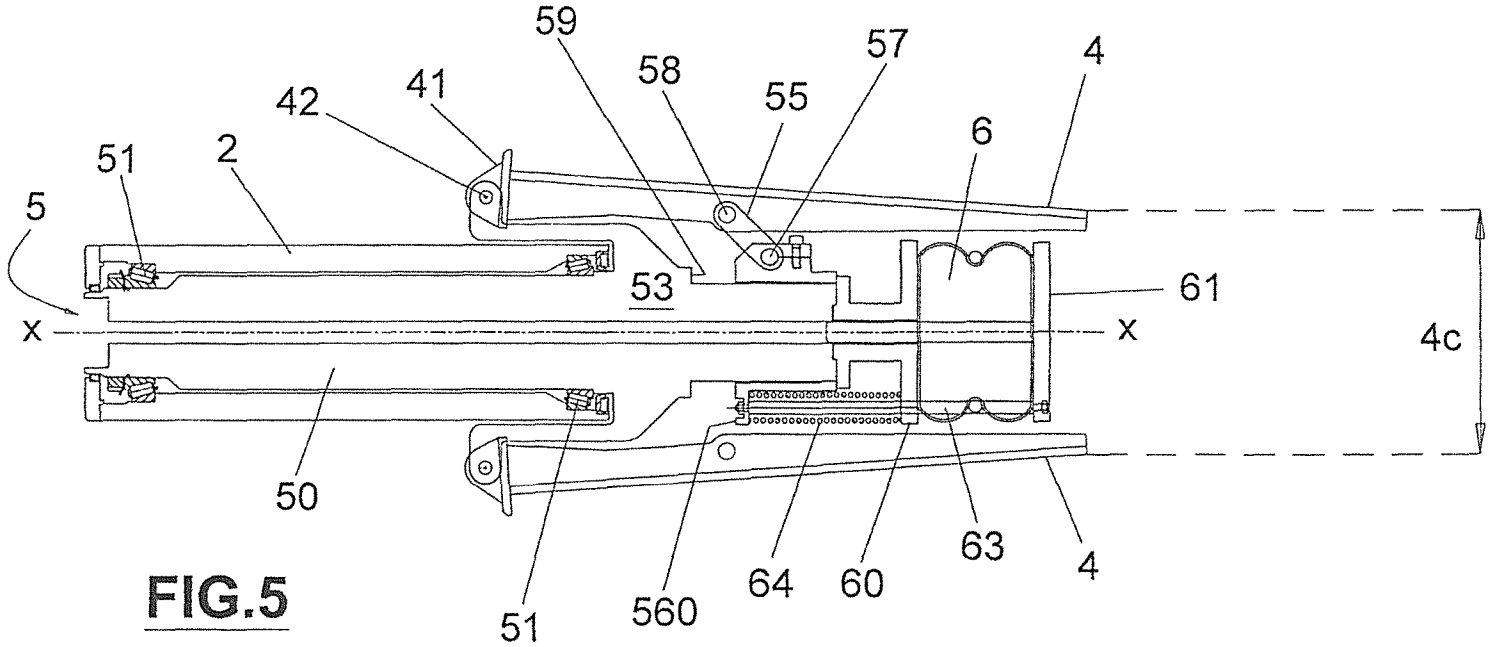
FIG. 5 is similar to FIG. 4A but shows the pin in the compressed configuration instead of the expanded configuration.

The outer side (PX) of the pin (P) is constituted by a shank (2) whose longitudinal axis coincides with the longitudinal axis (x-x) of the pin (P). On said shank (2) is fixed a handle (3), formed by two parallel arms (30) emerging radially from the shank (2) and joined by a body (31) parallel to said longitudinal axis (x-x). The handle (3) is applied on the upper side of the shank (2), i.e. on the side of the latter which, in operation, is turned upwards. The shank (2) is hollow. According to the example shown in the drawings, the inner side (PN) of the pin (P) is expandable: said inner side is expanded (as shown in FIG. 1, FIG. 2, FIG. 3, FIG. 4A and FIG. 4B) when it is inserted in the core (10) of the reel (1) so as to engage the latter, while it is compressed (as shown in FIG. 5) in order to be inserted in the core (10) or disengaged from the reel.

The outer surface of the inner side (PN) is formed by more sectors (4), four in number in this example, each of which is formed by a portion of cylindrical surface with a free front end (40) and a rear end (41). The pin (P) also comprises a body (5) having: a rear part (50) inserted longitudinally in the hollow shank (2) with the interposition of bearings (51); a front part (52) turned towards the front end (40) of the sectors (4) and consisting of a longitudinal extension of the rear part (50); and an outer cup-shaped part (53), whose inner diameter (d53) is greater than the outer diameter of the shank (2), in an intermediate point between the rear part (50) and the front part (52). In practice, the rear part (50) of body (5) is inserted in the shank (2), the intermediate part (53) is external to the shank that in part (i.e. on its most advanced part) is inside the cup-shaped intermediate part (53), and the front part (52) constitutes a prolongation of the body (5) that, as shown in the drawings, is internal to the sectors (4).

The rear end (41) of each sector (4) is constrained to the cup (53) of the body (5) by a pin (42) inserted in a radial wing (54) projecting externally from the same cup (53). Said wings (54), in this example, are four in number and are arranged at an angular distance of 90° from each other. The axis of each pin (42) is oriented along a tangential direction relative to the shank (2) whose surface is cylindrical. In addition, each pin (42) is spaced apart a predetermined value from the outer surface of the shank (2), being inserted in a wing (54) which acts as a spacer.

Each sector (4) is also constrained to the front part (52) of said body (5) via a connecting rod (55) hinged on one side (lower side) on a collar (56) mounted longitudinally slidable on the front (52) of the body (5) and, on the opposite side (upper side), on the inner surface of the respective sector (4). The connection of the connecting rod (55) to the collar (56) is formed by a pin (57) whose axis is parallel to the pin (42) that connects the rear part (41) of the sector (4) to the respective wing (54) of the cup (53); the connection of the same connecting rod (55) to the inner side of the sector (4) is made by means of a further pin (58) parallel to the previous one (57).

In front of the front end of the front part (52) of the body (5) is arranged a pneumatic spring (6) placed between two plates (60, 61) that are orthogonal to said axis (x-x). The first plate (60) has a rear extension (62) which acts as a spacer and is fixed to the front end of the front part (52) of the body (5). The second plate (61) is on the opposite side with respect to the pneumatic spring (6). Several rods (63) connect the second plate (61) with said collar (56): each rod (63) is fixed on one side to the second plate (61) and, on the opposite side, to a rear appendix (560) of the collar (56) and passes freely through a respective hole formed in the first plate (60). On each of the rods (63) is mounted a helical spring (64). The rods (63) and the helical springs (64) are oriented parallel to said axis (x-x) and are four in number in the example shown in the drawings.

When the pneumatic spring (6) is discharged, that is, compressed, the action of the helical springs (64) is such as to maintain the collar (56) set back on the front part (52) of the body (5): in this condition the rear part of the collar (56) is pushed by the springs (64) against an abutment surface (59) exhibited by the body (5) between its intermediate part (53) and the front part (52), and the sectors (4) are open, with the connecting rods (55) oriented along a radial direction, relative to the axis (x-x), that is oriented parallel to the load acting on the pin (P). The sectors (4) are kept normally open by the springs (64).

When the pneumatic spring (6) is charged, i.e. expanded, the resistance of the springs (64) is overcome and the collar (56) advances, together with the foot of the connecting rods (55), whereby the sectors (4) are closed with reciprocal approaching of the respective front ends (40).

The compressed air is introduced into the pneumatic spring (6), or removed, through a longitudinal through hole (5F) formed in the body (5). In this way, the sectors (4) can be opened and closed by rotating them about the pins (42).

The front ends (40) of the sectors (4) form a substantially circular shape whose outer diameter (4*a*; 4*c*) varies according to the configuration (open/closed) of the same sectors (4) between a maximum value (4*a*) and a minimum value (4*c*). Advantageously, the difference (Δ) between said maximum value (4*a*) and said minimum value (4*c*) is between 10% and 30% of the maximum value (4*a*): $0.30*(4a) \geq \Delta = (4a-4c) \geq 0.10*(4a)$.

Preferably, said difference (Δ) is comprised between 15% and 20% of the maximum value (4*a*): $0.20*(4a) \geq \Delta = (4a-4c) \geq 0.15*(4a)$.

More preferably, said difference (Δ) is comprised between 15% and 18% of the maximum value (4*a*): $0.18*(4a) \geq \Delta = (4a-4c) \geq 0.15*(4a)$.

FIGS. 6-11 show a possible sequence of movements related to the loading of a parent reel (1) on an unwinder (S) provided, on each of its sides, with a movable semi-collar (SM) controlled by an actuator (AS) that—in a manner per se known—by means of levers (LS) makes it rotate clockwise (closing direction) or counterclockwise (opening direction) above a fixed support cradle (SF): when the pin (P) is above the cradle (SF), the rotation of the movable semi-collar (SM) in a clockwise direction causes the engagement of the outer part (PX) of the pin (P) with the respective side of the unwinder (S). On the contrary, the counterclockwise rotation of the movable semi-collar (SM) determines the release of the pin (P) from the unwinder (S).

In FIG. 6 the parent reel (1) with the pins (P) inserted in both ends of its core (10) is hooked to the movable arms (BC) of the bridge crane (CP) while the mobile semi-collars (SM) of unwinder (S) are open. In particular, each movable arm (BC) of the bridge crane (CP) is provided, on its free end, with a movable hook (G) which, in turn, has a hook-shaped free end to be more easily placed under the body (31) of the handle (3). The hook (G) is hinged on the free end of said movable arm (BM) by a pin with horizontal axis (PG) and has a rear side connected to a pneumatic spring (MP) by which the same hook (G) can be rotated clockwise or counterclockwise about the pin (PG). The movement of the movable arm (BC) is controlled by a respective actuator (AP).

Figure 7:
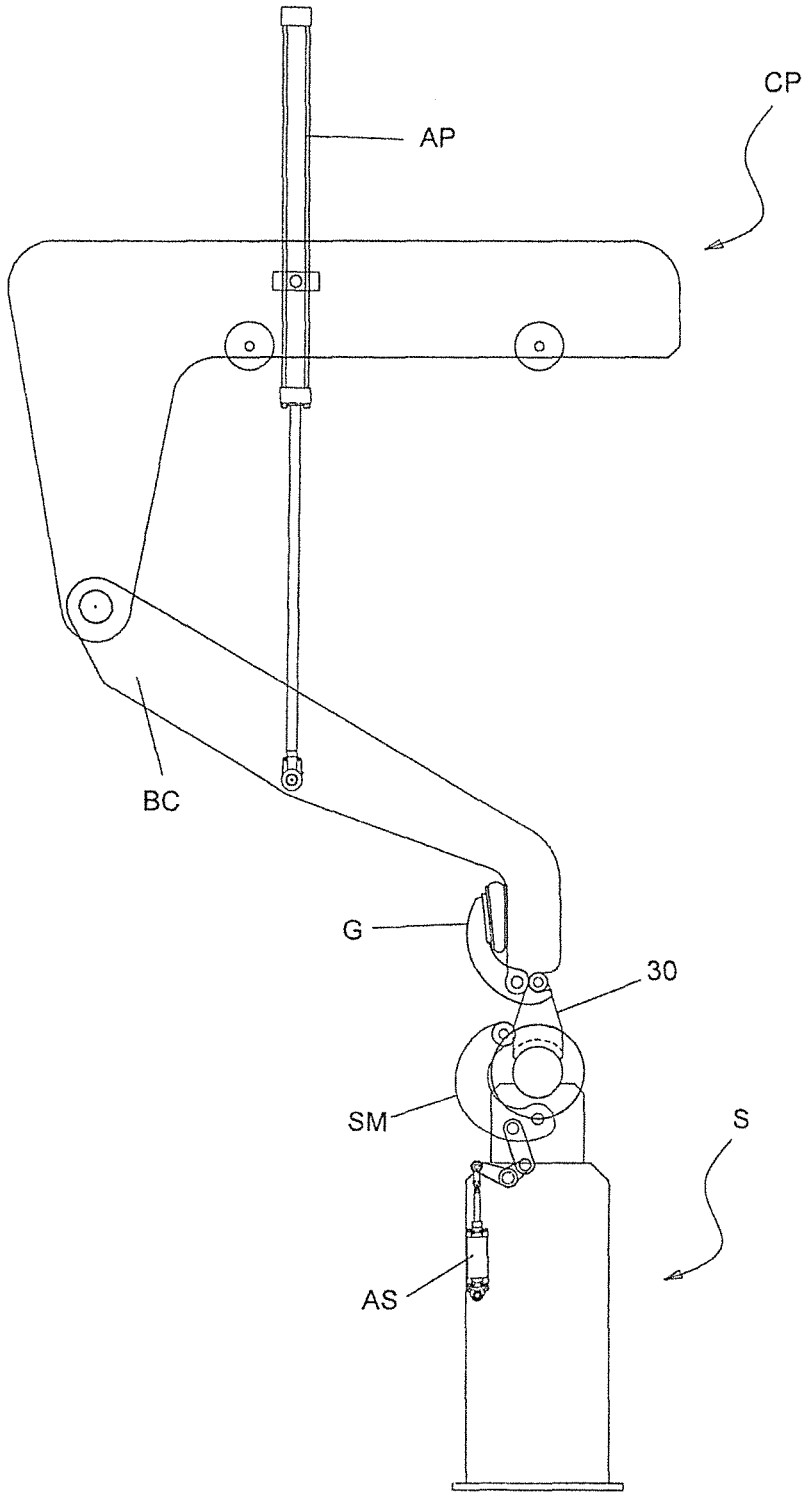

In FIG. 7 the movable arm (BM) of the bridge crane (CP) has been lowered by means of the actuator (AC), the pin (P) is on the cradle (SF) of the unwinder (S), the hook (G) holds the handle (3) and the mobile semi-collars (SM) are open.

Figure 8:
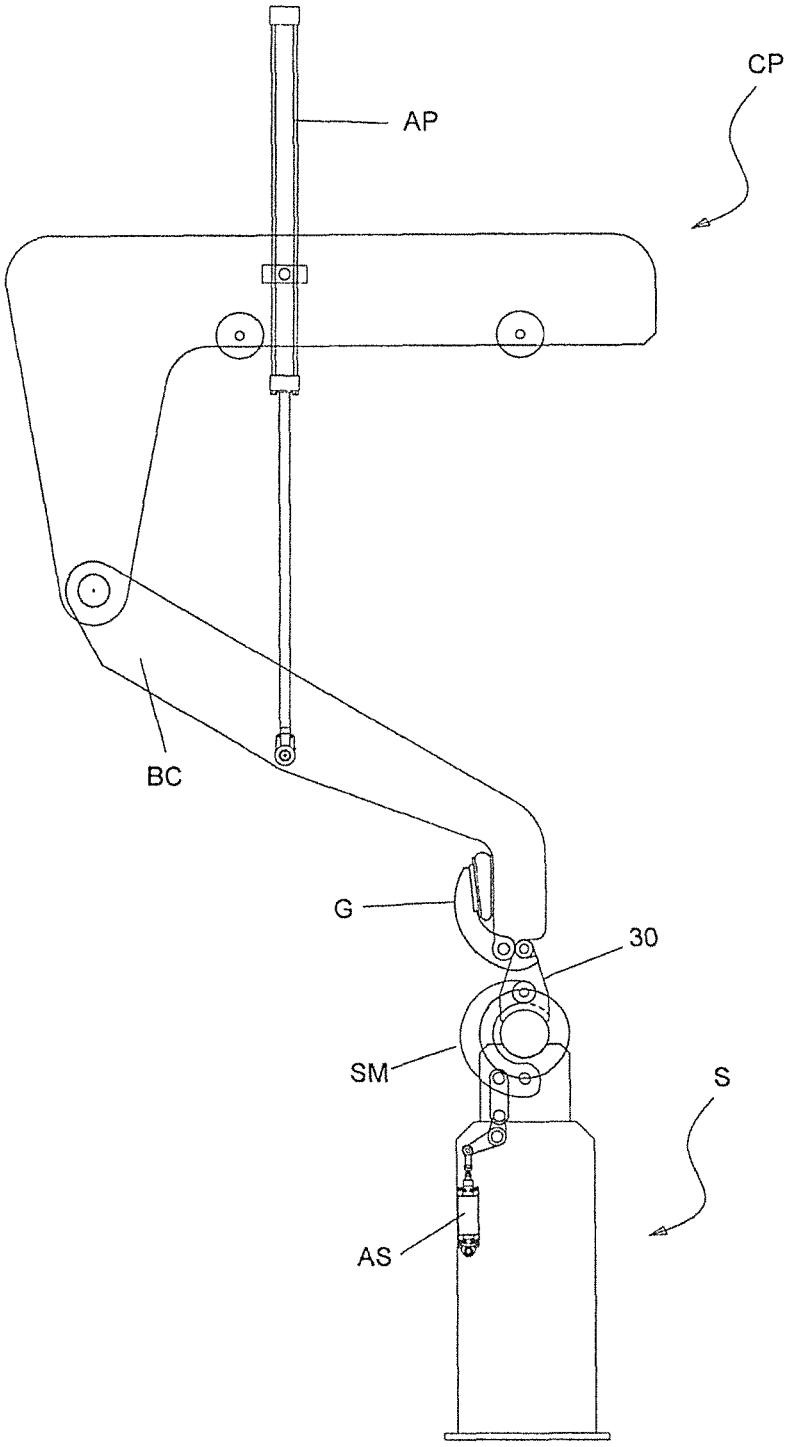

In FIG. 8, while the hook (G) still retains the handle (3) of the pin (P), the semi-collars (SM) are rotated clockwise to lock the pin (P) to the unwinder (S).

Figure 9:
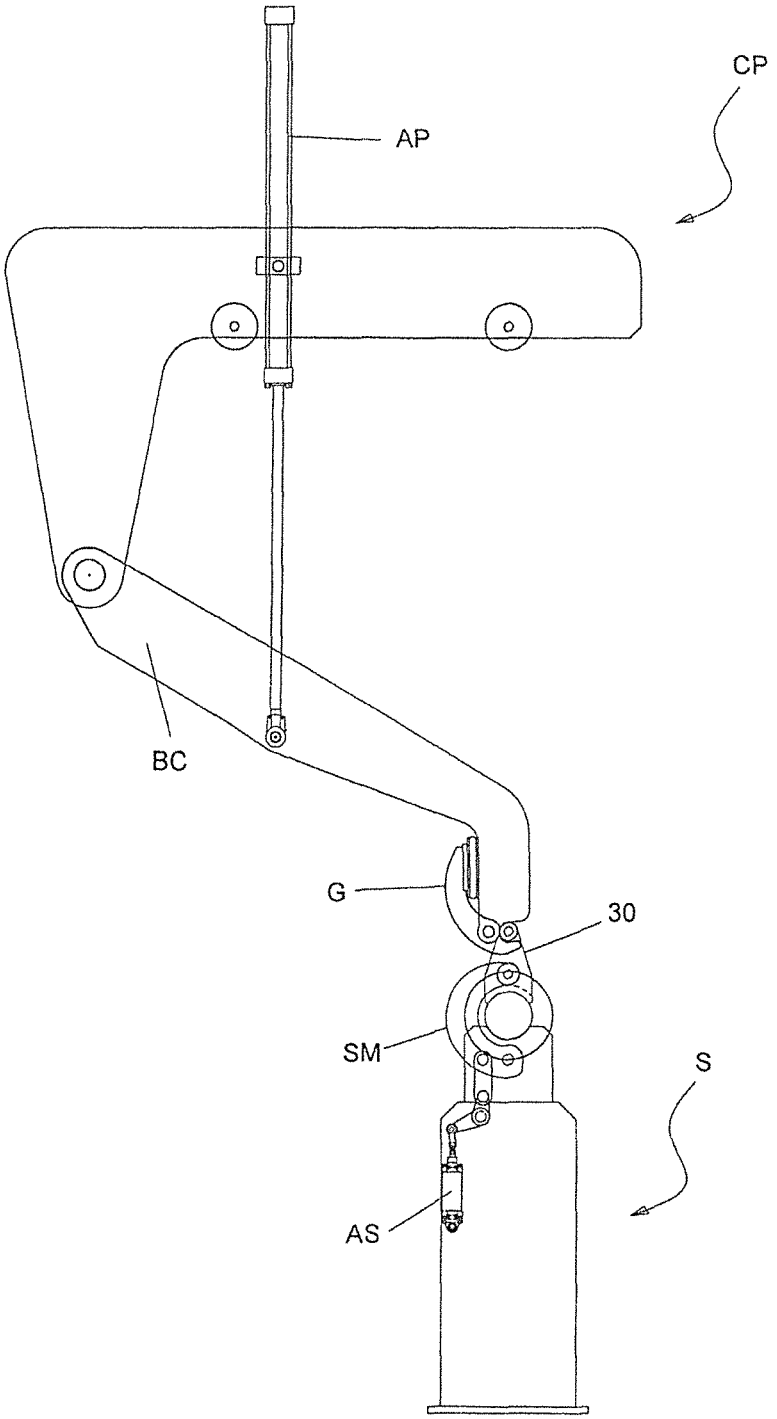

In FIG. 9 the hook (G) of the bridge crane (CP) is rotated to release it from the handle (3) of the pin (P).

Figure 10:
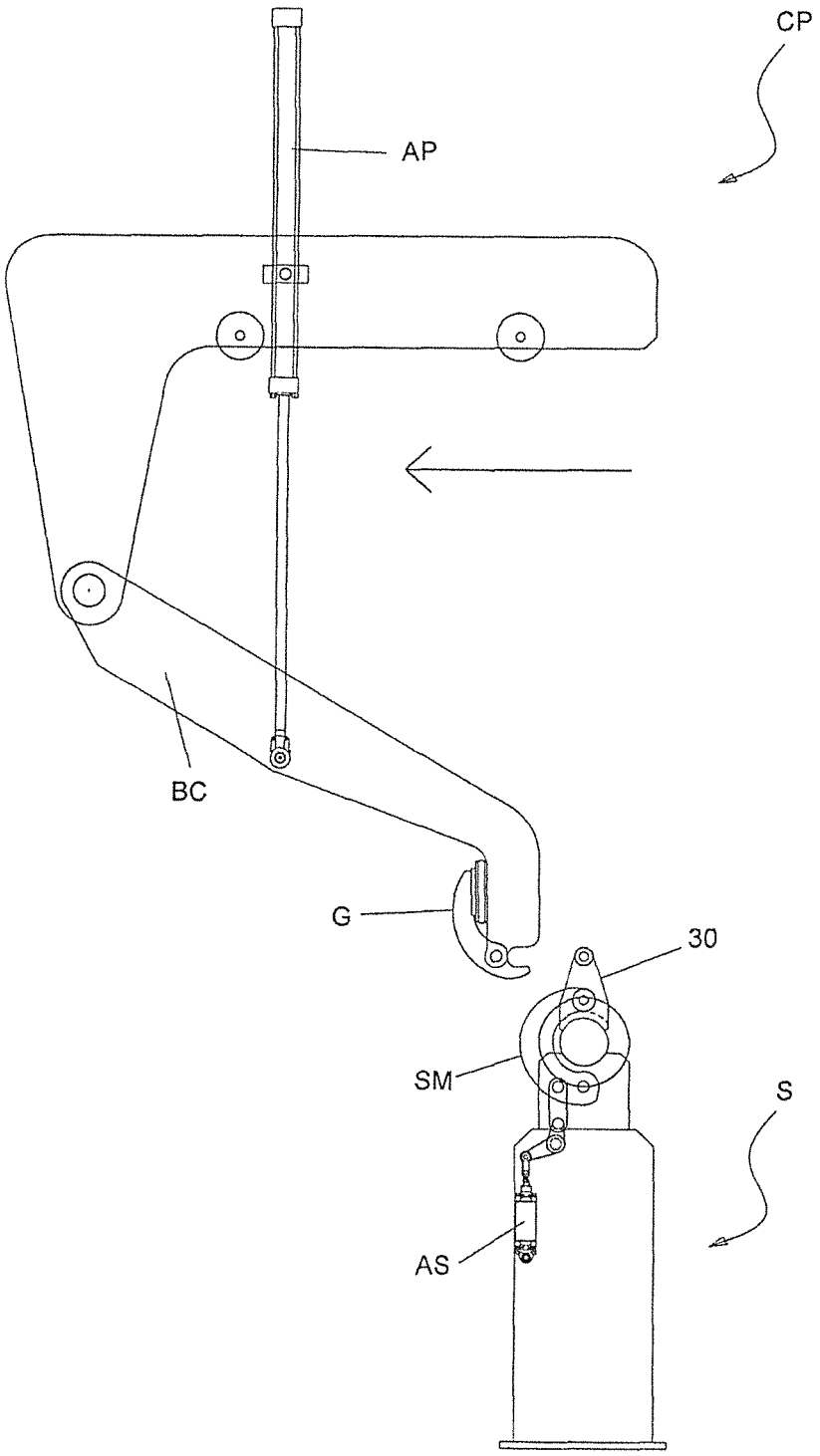
Figure 11:
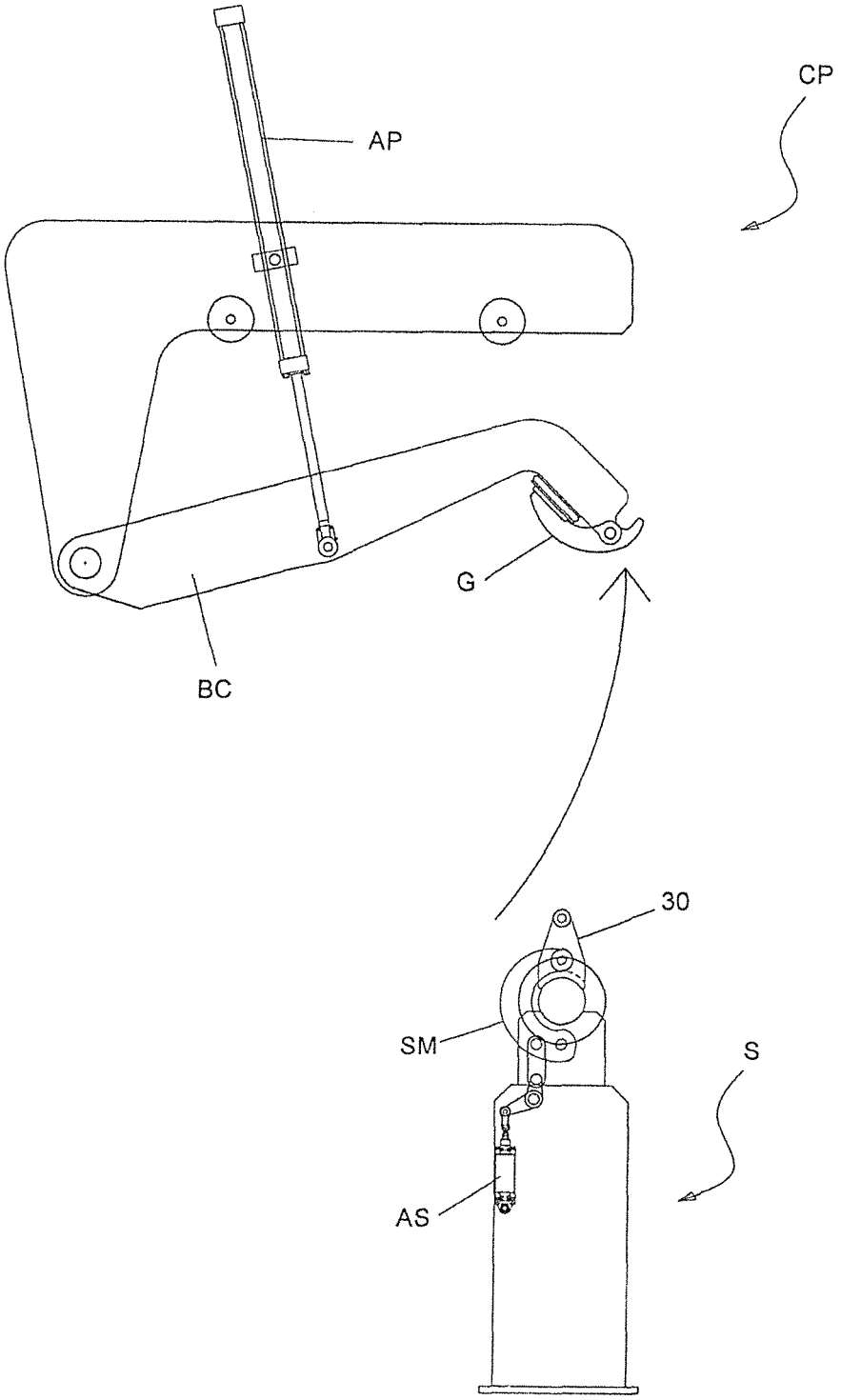

Since the arms (BC) of the bridge crane (CP) are moved to obtain their mutual approach and spacing, as schematically shown by the double arrow "FB" in FIG. 12, the same arms (BC) are apt to provide for the insertion of pins (P) in the two ends of the core (10) of the reel (1) and, respectively, for their disconnection. FIG. 10 and FIG. 11 show the mobile arm of the bridge crane that moves away from the unwinder (S).

To disengage the reel (1) with pins (P) from the unwinder (S) the sequence is opposite to that described above.

It is noted that the reel is always supported by the arms (BC) of the bridge crane (CP) or by the unwinder (S) or by both these elements.

Since the handles (3) are engaged to the hooks (G), each of the pins (P) can oscillate on its hook (G), and this favors the self-alignment of the pins (P) with the axis of the reel (1) during insertion of the pins in the core (10) of the latter.

FIG. 15 schematically shows the forces (RA) acting on the reel (1) during the raising of the same: the distribution of forces is such as to avoid, or at least greatly reduce, the bending of the core (10) which, in addition, is not subject to appreciable buckling loads. As previously mentioned, the handle (3) on the pin (P) allows the hooking of the latter to the respective arm of the bridge crane while the same pin (P) is still on the unwinder (S).

In practice the execution details may vary in any equivalent way in relation to the elements described and shown in the drawings, without departing from the adopted solution idea and then remaining within the limits of the protection granted by the present patent.

The invention claimed is:

1. A support pin for supporting reels of paper material, the support pin comprising:

an outer side and an inner side, the inner side being adapted to be inserted into a reel of paper material and the outer side remaining on an outside of the reel when the inner side is inside the reel, said outer side being provided with a hooking portion adapted to be engaged by a means for vertically moving the pin, the outer side of the pin comprising a shank having a shank longitudinal axis coinciding with a pin longitudinal axis of the pin and said hooking portion comprising an eyelet formed on the shank and delimited by two parallel arms that emerge radially from the shank and the two parallel arms are joined by a body parallel to said pin longitudinal axis.

2. A support pin according to claim 1, wherein said eyelet is applied on a side of the shank that is turned upwards when the support pin is in operation.

3. A support pin according to claim 1, wherein an outer surface of said inner side is formed by sectors, each of the sectors being formed by a cylindrical surface portion with a free front part to provide a number of front parts, the front parts of said sectors defining a substantially circular shape with a diameter varying between a maximum value (4*a*) and a minimum value (4*c*), and a difference (A) between said maximum value (4*a*) and said minimum value (4*c*) is comprised between 10% and 30% of the value maximum (4*a*): $0.30*(4a)\geq\Delta=(4a-4c)\geq0.10*(4a)$.

4. A support pin according to claim 3, wherein each of said sectors has a rear part pivoted on a respective hinge and an intermediate part connected to a moving means for determining rotation of a respective one of said sectors around said hinge.

5. A support pin according to claim 4, wherein a rear end of each sector is constrained to an outer cup-shaped part of an inner side body of the inner side by a pin inserted in a radial wing projecting externally from the outer cup-shaped part, an axis of each pin being oriented in a tangential direction with respect to the shank, and each pin being spaced by a predetermined value from an outer surface of the shank, each pin being inserted in a respective radial wing which acts as a spacer.

6. A support pin according to claim 4, wherein said moving means is an elastic moving means.

7. A support pin according to claim 6, wherein said elastic moving means comprises a plurality of helical springs.

8. A support pin according to claim 6, wherein said elastic moving means comprises a pneumatic spring.

9. A support pin according to claim 3, wherein the shank is cylindrical and the shank has an internal cavity and the inner side comprises an inner side body having: a rear part inserted longitudinally into the internal cavity of the shank with interposition of bearings; a front part turned towards one or more of the front ends of the sectors and the front part comprising a longitudinal extension of the rear part; and an outer cup-shaped part having an inner diameter that is greater than an outer diameter of the shank, in an intermediate area between the rear part and the front part, so that the rear part of the inner side body is inserted in the shank, the outer cup-shaped part being external to the shank that in part is inserted into the outer cup-shaped part, and the front part comprising an extension of the inner side body which is internal to the sectors.

10. A support pin according to claim 9, wherein in front of a front end of the front part of the inner side body is disposed an air spring placed between a first plate and a second plate that are perpendicular to said pin longitudinal axis.

11. A support pin according to claim 10, wherein:

the first plate has a rear extension which acts as a spacer and is fixed to the front end of the front part of the inner side body and the second plate is on an opposite side with respect to the air spring;

a plurality of rods connect said second plate with a collar, each of the rods being fixed on one side to the second plate and on the opposite side to a rear appendix of the collar and each of the rods passes freely through a respective through hole provided in the first plate;

a helical spring fitted on each of the rods to provide a number of helical springs;

said rods and said helical springs are oriented parallel to said pin longitudinal axis.

12. A support pin according to claim 11, wherein, when the pneumatic spring is discharged, the helical springs maintain the collar on the rear part of the inner side body and the rear part of the collar is pushed by the helical springs against an abutment surface provided by the inner side body between the outer cup-shaped part and the front part, and the sectors are open with connecting rods in a radial position relative to the pin longitudinal axis, oriented parallel to a load acting on the pin, the sectors being maintained normally open by the springs; and when the pneumatic spring is charged, resistance of the helical springs is overcome and the collar advances, together with a foot of the connecting rods, such that the sectors move towards each other with mutual approach of respective front parts.

13. A support pin according to claim 3, wherein:

each sector is bound to the front part of an inner side body of the inner side via a connecting rod hinged to a lower side of a collar mounted longitudinally slidable on the front part of the inner side body and, from an opposite upper side, on an inner surface of a respective sector;

a connection of the connecting rod to the collar is made by a connecting pin with an axis parallel to a respective pin which connects a rear part of the sector to a respective wing of a cup-shaped part;

a connection of the connecting rod to the inner surface of the sector is made by means of a further pin parallel to the connecting pin.

14. A support pin according to claim 1, wherein an outer surface of said inner side is formed by sectors, each of the sectors being formed by a cylindrical surface portion with a free front part to provide a number of front parts, the front parts of said sectors defining a substantially circular shape with a diameter varying between a maximum value (4*a*) and a minimum value (4*c*), and a difference (A) is comprised between 15% and 20% of the maximum value (4*a*): $0.20*(4a)\geq\Delta=(4a-4c)\geq0.15*(4a)$.

15. A support pin according to claim 1, wherein an outer surface of said inner side is formed by sectors, each of the sectors being formed by a cylindrical surface portion with a free front part to provide a number of front parts, the front parts of said sectors defining a substantially circular shape with a diameter varying between a maximum value (4*a*) and a minimum value (4*c*), and a difference (Δ) is comprised between 15% and 18% of the maximum value (4*a*): $0.18*(4a)\geq\Delta=(4a-4c)\geq0.15*(4a)$.

* * * * *